US009011214B2

(12) United States Patent
Karlsson et al.

(10) Patent No.: US 9,011,214 B2
(45) Date of Patent: Apr. 21, 2015

(54) RIM GEOMETRY OF A COIN SORTING DEVICE

(71) Applicant: Scan Coin AB, Malmo (SE)

(72) Inventors: Jerry Karlsson, Lund (SE); Peter Gillstedt, Loddekopinge (SE); Markus Jonasson, Malmo (SE); Robert Gustavsson, Lund (SE)

(73) Assignee: Scan Coin, AB, Malmo (SE)

( * ) Notice: Subject to any disclaimer, the term of this patent is extended or adjusted under 35 U.S.C. 154(b) by 0 days.

(21) Appl. No.: 14/224,493

(22) Filed: Mar. 25, 2014

(65) Prior Publication Data

US 2014/0295744 A1 Oct. 2, 2014

(30) Foreign Application Priority Data

Mar. 28, 2013 (EP) ..... 13161542

(51) Int. Cl.
*G07D 3/06* (2006.01)
*G07D 9/00* (2006.01)

(52) U.S. Cl.
CPC . *G07D 3/06* (2013.01); *G07D 9/008* (2013.01)

(58) Field of Classification Search
CPC ..... G07D 3/00; G07D 3/06
USPC ..... 453/3, 5, 9, 12, 49, 57
See application file for complete search history.

(56) References Cited

U.S. PATENT DOCUMENTS

| | | | | |
|---|---|---|---|---|
| 3,978,962 | A | 9/1976 | Gregory, Jr. | |
| 4,059,122 | A | 11/1977 | Kinoshita | |
| 4,943,258 | A | 7/1990 | Abe | |
| 4,988,860 | A | 1/1991 | Wollet et al. | |
| 5,240,099 | A | 8/1993 | Brown et al. | |
| 5,382,191 | A | 1/1995 | Rasmussen | |
| 6,138,813 | A | 10/2000 | Lamb, Jr. et al. | |
| 6,168,001 | B1 | 1/2001 | Davis | |
| 6,350,193 | B1 | 2/2002 | Paulsen | |
| 6,679,770 | B1 | 1/2004 | Sugai et al. | |
| 7,490,709 | B2 | 2/2009 | Jönsson | |
| 7,658,668 | B2 * | 2/2010 | Hill | 453/57 |
| 8,202,144 | B2 | 6/2012 | Hino et al. | |
| 2009/0305620 | A1 * | 12/2009 | Hino et al. | 453/5 |
| 2013/0277177 | A1 * | 10/2013 | Kuesel | 198/810.01 |

FOREIGN PATENT DOCUMENTS

| | | | | |
|---|---|---|---|---|
| CN | 201331787 Y | 10/2009 | ..... | G07D 9/00 |
| DE | 10 2010 049 208 A1 | 4/2012 | ..... | G07D 3/16 |
| EP | 0 469 886 | 8/1990 | ..... | G07D 1/00 |
| EP | 0 950 989 | 10/1999 | ..... | G07D 9/00 |
| WO | WO 94/23397 | 10/1994 | ..... | G07D 3/00 |

(Continued)

OTHER PUBLICATIONS

European Search Report Dated Sep. 13, 2013, for co-pending European Patent Application No. 13161528.8, (8 pages).

(Continued)

*Primary Examiner* — Mark Beauchaine

(74) *Attorney, Agent, or Firm* — Womble Carlyle Sandridge & Rice LLP

(57) ABSTRACT

The present disclosure relates to a coin sorter wherein a flexible rim (606) is used for engaging a coin (706) to be sorted and bring the coin in abutment with a circular border (620) of the coin sorter in a path across a plurality of circularly arranged coin openings.

22 Claims, 7 Drawing Sheets

(56) References Cited

FOREIGN PATENT DOCUMENTS

| | | | | |
|---|---|---|---|---|
| WO | WO 97/05581 | 2/1997 | ..... | G07D 9/00 |
| WO | WO 97/07485 | 2/1997 | ..... | G07D 3/06 |
| WO | WO 99/33030 | 7/1999 | ..... | G07D 3/16 |
| WO | WO 03/049049 | 6/2003 | ..... | G07D 9/00 |
| WO | WO 2008/024043 | 2/2008 | ..... | G07D 9/00 |

OTHER PUBLICATIONS

European Search Report Dated Sep. 12, 2013, for co-pending European Patent Application No. 13161542.9, (8 pages).

* cited by examiner

RIM GEOMETRY OF A COIN SORTING DEVICE

CROSS-REFERENCE TO RELATED APPLICATIONS

This application claims the benefit of European Patent Application No. 13161542.9, filed on Mar. 28, 2013.

INCORPORATION BY REFERENCE

The entire disclosure of European Patent Application No. 13161542.9, filed on Mar. 28, 2013, is incorporated herein by reference as if set forth in their entireties.

TECHNICAL FIELD

The present disclosure relates to a coin sorter and specifically to a resilient rim of the coin sorter.

BACKGROUND OF THE DISCLOSURE

Retail cash systems (RCS) are used for handling of cash, such as notes (bills), cheques or coupons in a retail establishment. The systems generally comprise a coin deposit apparatus and a coin dispensing apparatus.

The coin deposit apparatus has to discriminate between different types of acceptable coins, such as valid coins in a plurality of denominations in one or more specific currencies. Preferably, it should also be capable of detecting unacceptable cash, such as fake (counterfeit) coins or coins of a foreign currency. In the coin deposit apparatus a coin acceptance module (CAM) handles the discrimination of coins and is also adapted to count the coins to register the deposited amount. One typical user is a cashier emptying a till after a work shift.

The CAM includes a coin sorter. An important feature of the coin sorter is of course the accuracy of the coin sorting. A further important feature of the coin sorter is the highest coin sorting speed not resulting in reduction of the accuracy of the coin sorting.

WO09025968 (Adams et al.) discloses coin handling machine with a driving member disposed over a sorting disc, the driving member comprising narrow fins for moving the coin along an outside reference edge. The plurality of fins may make the manufacturing process complex, and the shape of the fins may not ensure that the coins are pressed towards the outside reference edge to increase the coin sorting accuracy.

SUMMARY OF THE DISCLOSURE

In view of the above, an objective of the disclosure is to solve or at least reduce one or several of the drawbacks discussed above. Generally, the above objective is achieved by the attached independent patent claims.

According to a first aspect, the present disclosure is realized by a coin sorter comprising: a base plate comprising: an upper and a lower surface, the upper surface having a circular border having an opening, and a plurality of circularly arranged coin openings, each coin opening being in vicinity of the border, a carrier disc mounted above the upper surface of the base plate, the carrier disc being concentric with respect to the circular border of the base plate and rotatable around an center axis of the base plate, the carrier disc comprising a resilient rim on the side facing the upper surface of the base plate, the rim being aligned with the plurality of circularly arranged coin openings, wherein the coin sorter is arranged to receive a coin through the opening of the circular border, wherein the resilient rim is arranged to engage the coin and bring the coin in abutment with the circular border in a path across the plurality of circularly arranged coin openings, wherein the resilient rim comprising at least one circumferentially arranged projecting part, each projecting part of the at least one projecting part is projecting in a direction perpendicular from the carrier disc towards the upper surface of the base plate, or a direction away from the circular border towards the upper surface of the base plate, wherein at least one projecting part is adapted for always being folded inwards towards the center of the carrier disc and away from the circular border when engaging a coin to be sorted.

As used herein, the term "coin openings" shall be understood to not only include the openings illustrated in the drawings and explained herein, but also sorting grooves, channels and exits seen in the prior art.

As used herein, the term "each coin opening being in vicinity of the border" shall be understood to include that each coin opening is positioned nearby the border or at a predefined small distance from the border. The distance to the border should be as small as possible but still large enough such that a coin brought over a coin opening with a smaller width than the width of the coin is not falling in the coin opening if brought over in abutment with the border.

As used herein, the term "away from the circular border" shall be understood that the at least one projecting part is projecting in an angle from the carrier disc towards the center of the carrier disc.

According to another embodiment of the present disclosure, each projecting part of the at least one projecting part is tapered in the projecting direction.

As used herein, the term "tapered" shall be understood to mean that the end of the projecting part, the part closes to the upper surface of the base plate, is narrower than the base of the projecting part. The reduction in width is not necessarily equal along the entire projecting part.

According to yet another embodiment of the present disclosure, each tapered projecting part is tapered within the range of 1-5 degrees.

According to a further embodiment of the present disclosure, each projecting part of the at least one projecting part is made from one of Nitrile rubber, TPE and TPU. According to further embodiments, each projecting part of the at least one projecting part is made from a material with similar flexibility and durability properties as Nitrile rubber, TPE or TPU.

According to an embodiment of the present disclosure, the complete resilient rim is made from Nitrile rubber, TPE or TPU.

According another embodiment of the present disclosure, the resilient rim comprising two circumferentially arranged projecting parts, the two projecting parts being separated such that one projecting part being arranged closer to a center of the carrier disc compared to the other.

According to yet another embodiment of the present disclosure, the two projecting parts are separated from each other by a distance within the range of 5-8 mm.

According to another embodiment of the present disclosure, the projecting part at the longest distance from the center of the carrier disc is projecting at a distance within the range of 4-7 mm from the outer edge of the resilient rim.

According to yet another embodiment of the present disclosure, the two projecting parts both are projecting slightly towards the centre of the carrier disc holding the resilient rim.

According to another embodiment of the present disclosure, each projecting part of the at least one projecting part protrudes by a distance from the carrier disc within the range of 7.5-9 mm.

According to yet another embodiment, the widest part of each projecting part of the at least one projecting part has a thickness within the range of 1-4 mm.

According to a second aspect of the present disclosure, there is provided a coin counting and sorting device comprising a coin sorter according to the first aspect of the present disclosure, a coin bowl, adapted for receiving a mass of coins to be sorted, a coin lifting device for receiving and forwarding the mass of coins to be sorted from the coin bowl, a inclined rail block for transporting the forwarded the mass of coins from the coin lifting device, individually, (passively) to coin sorter, the coin sorter, coin bowl, coin lifting device and inclined rail block being mounted on a front plate of the coin counting and sorting device, wherein the inclined rail block is designed to deliver the transported coins towards the border of the base plate of the coin sorter.

According to an embodiment of the present disclosure, inclined rail block has an angled end portion, the angled end portion is arranged to transport the coin from a plane behind the coin sorter to the plane of the coin sorter.

According to a third aspect of the present disclosure, there is provided a coin deposit and dispensing apparatus comprising the coin counting and sorting device according to the second aspect of the present disclosure.

The second and third aspect may generally have the same features and advantages as the first aspect.

It is noted that embodiments of the disclosure relate to all possible combinations of features recited in the claims. Generally, all terms used in the claims are to be interpreted according to their ordinary meaning in the technical field unless explicitly defined otherwise herein.

Other objectives, features and advantages of the present disclosure will appear from the following detailed disclosure as well as from the drawings.

BRIEF DESCRIPTION OF THE DRAWINGS

This and other aspects of the present disclosure will now be described in more detail, with reference to the appended drawings showing embodiments of the disclosure, wherein.

DETAILED DESCRIPTION

Figure 1:
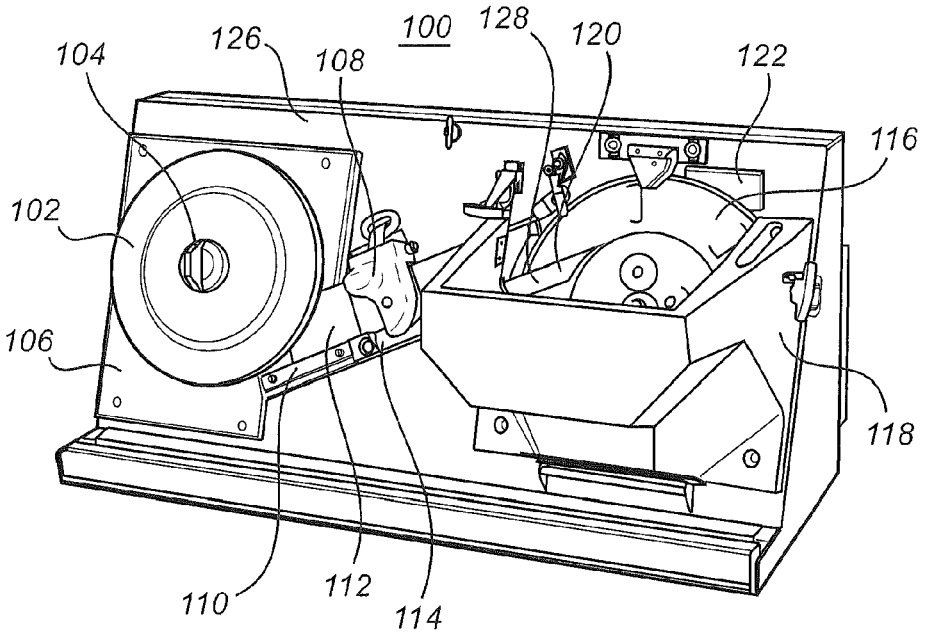
FIG. 1 illustrates a coin counting and sorting device according to embodiments of the present disclosure

Embodiments of the disclosure are based on the idea of providing a coin sorter having a resilient rim with at least one projecting part that is adapted to bring the coins to be sorted with a considerable speed across the coin openings of the base plate and adapted to press the coin towards the border of the base plate. Since the sorting accuracy for the coin sorter depends on the fact that the coin to be sorted is pressed towards the border of the base plate, the design and properties of the resilient rim are of utterly importance. By providing the resilient rim having at least one projecting part projecting according to embodiments of the present disclosure, the resilient rim will provide an adequate pressure to the coin to be sorted towards the border of the base plate and thus the risk of miss sorting is reduced. Moreover, the resilient rim will provide a more consistent pressure to the coin to be sorted towards the border of the base plate independently of the coin thickness, thus leading to a more homogeneous eject behavior of the coins through the coin opening which significantly reduces the risk of jams in channels leading coins from the coin opening. Moreover, a perpendicular projecting direction of the at least one projecting part may be advantageous for manufacturing reasons.

By providing a tapered projecting part, a correct folding behavior for the projecting part may be improved. The at least one projecting part should always be folded inwards towards the center of the carrier disc and away from the border when engaging a coin to be sorted to ensure that the coin is firmly pressed towards the border of the base plate and thus sorted correctly. As is clearly understood from reference to the other portions of this text and from, for example, reference to FIGS. 7 and 8 and also FIGS. 9, 10*a-c*, another way of equivalently stating the foregoing expression of "always folded inwards . . . when engaging a coin" would be to say that, according to one embodiment, the projecting part projects from the carrier disc and is resilient and, in response to the projecting part engaging a coin, the projecting part is bent/folded inwards toward the center of the carrier and away from the boarder. The tapered shape assists with this folding/bending response. The tapered shape of the projecting part is further advantageous for manufacturing reasons.

To provide the adequate pressure on a coin to be sorted, and to provide a long lasting resilient rim, the material of the at least one projecting part is advantageously a flexible and durable material such as Nitrile rubber, TPE or TPU or another suitable material with similar properties. Moreover, in the case the resilient rim is molded, TPE or TPU is an advantageous choice but another suitable material with similar properties is equally possible. In this case, the entire rim is advantageously made from the same material.

Besides the ability to sort correctly, an important ability of the coin sorter is the speed of sorting. By providing a rim with two projecting parts separated such that one projecting part being arranged closer to a center of the carrier disc compared to the other, the speed of sorting may be increased. In this embodiment, the area of contact between the rim and the coin to be sorted is increased without the rim reducing its pressuring ability. By increasing the area of contact, the friction between the rim and the coin is increased. Consequently, the speed of the carrier disk may be increased without the rim loosing it engaging power to the coin when moving it in the path over the coin openings. To reduce the risk of a small coin getting stuck between the two projecting parts, they are, according to an embodiment, separated from each other within the range of 5 to 8 mm. Above 8 mm there is a risk that for example the one cent euro coin gets stuck between the projecting parts. By placing the outer projecting part within the range of 4-7 mm from the outer edge of the resilient rim, the risk of a small coin getting stuck between a holder of the rim and the base of the outer projecting part may be reduced. The range of 4-7 mm is further advantageous in that the inner projecting part may in this case still put pressure on a small coin. Moreover, the above radial positions of the projecting parts may be advantageous for forming the consistent pressure needed for reduce the miss sorting of the coins to be sorted. To further ensure the consistent pressure, it may be advantageous if the two projecting parts are projecting with the same angle from the carrier disc. In this embodiment, the direction and quantity of the pressuring force on the coin to be sorted from both projecting part will be the same.

The coin sorter may be used in a coin counting and sorting device. Such a device is often constructed such that the coin to be sorted is transported to the coin sorter on an inclined rail block. It may be advantageous if the inclined rail block is designed to deliver the transported coin to the coin sorter such that the resilient rim will engage the coin in good time before the first coin opening of the base plate. Consequently, the at least one protruding part of the resilient rim will have a certain distance available before the coin have to be pressured towards the border of the base plate, e.g. before the first coin opening. This may be advantageous if for example the coin is bouncing slightly just when the coin is grabbed by the rim. According to embodiments of the present disclosure, the resilient rim may engage the transported coin at coin at least 35 mm before the first coin opening which may reduce the miss sorting. In the case of the inclined rail block being mounted to the coin counting and sorting device in a plane behind the plane of the coin sorter, an angled end portion of the inclined rail block may be an simple and easy to manufacture solution to ensure that the resilient rim can engage the transported coin at the proper distance from the first coin opening.

Aspects of this disclosure will now be described more fully hereinafter with reference to the accompanying drawings, in which currently preferred embodiments of the disclosure are shown. The invention may, however, be embodied in many different forms and should not be construed as limited to the embodiments of the disclosure set forth herein.

FIG. 1 shows by way of example a coin sorting and counting device 100. The coin sorting and counting device 100 comprises a coin sorter 102 mounted on a front plate 126 of coin sorting and counting device 100 by a locking knob 104. The coin sorter 102 comprises a base plate 106 firmly mounted on the front plate 126. The coin sorting and counting device 100 further comprises a coin bowl 118 which is open at its upper portion, for depositing the mass of coins to be sorted. Inside the coin bowl 118 there is provided a rotatable and flexible rubber disc 116 for engaging the coins to be sorted and lifting them up towards a coin separating knife 128 which is arranged in contact with the rubber disc 116. A overfill protection device 122 ensures that not too many coins are deposited in the coin bowl 118 at once.

The coin separating knife 128, one end 120 of which according to the above is arranged in connection with the rubber disc 116, is at a downward inclination and is connected at its second end 114 to an anti bounce block 110 which will be described in greater detail below. The coin separating knife 128 and the anti bounce block 110 are mounted on an inclined rail block 112. A coin brought into contact to the separating knife 128, by the rotation of the rubber disc 116, and thus separated from the mass of coins to be sorted will by the inclination of the separating knife 128 be brought into a rolling downward motion along the upper side of the separating knife, which has been made flat so as to avoid coins from falling off the knife once separated, towards the front coin sensor 108. When the coin is transported the inclined rail block 112 will support the planar surface of the coin while the upper side of the separating knife 128, and later the anti bounce block 110, will support its perimeter. When rolling down the coin separating knife 128, the coin may for different reasons start to bounce. The coin may for example not be completely round, as in the case of for example British 20 and 50 pence coins, or the bouncing movement may originate from when the coin are separated at the coin bowl 118, or for some other reason. The functionality of the anti bounce block 110 will now be described in conjunction with FIG. 2.

Figure 2:
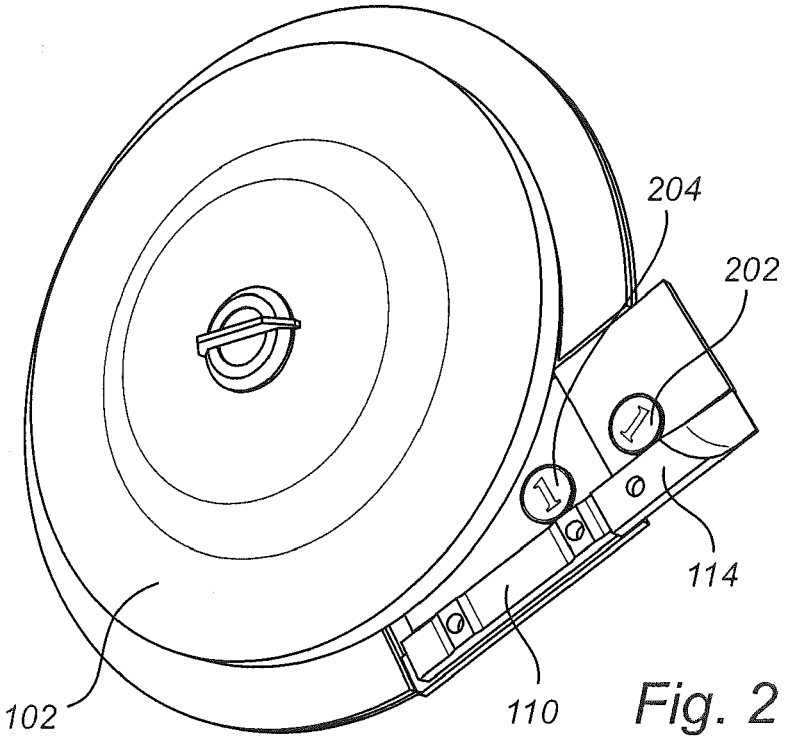
FIG. 2 illustrates two coins being transported on the inclined rail block towards the coin sorter.

FIG. 2 shows two coins 202, 204 being transported by the inclined rail block 112 to the coin sorter 102. The first coin 204 has just left the second end 114 of the coin separating knife 128 and is now transported by the anti-bounce block 110 and is soon to be engaged by the resilient rim (not shown) of the coin sorter 102. As described above, the transported coins 204, 202 may for different reasons bounce when transported by the inclined rail block 112. If the perimeter of the coin 202, 204 is not in abutment with the anti bounce block 110 when engaged by the resilient rim, miss sorting may occur since its height wise location in relation to the anti bounce block 110 is uncertain. The coin sorter 102 is designed to manage bouncing coins to a certain extent, but if the coin is bouncing too much, miss sorting may occur. As described above, it may be important that the rim of the coin sorter 102 provides adequate and consistent pressure to the coin 202, 204 to be sorted towards the border of the base plate, and if the coin is bouncing when engaged by the rim, the force by which the rim affects the coin 202, 204 may vary. As can be understood from the above, the bouncing of the coin needs to be reduced.

When trying to solve this problem, the inventors tried a variety of different possible solution. Some solutions included an anti bounce block which could move up and down in relation to the inclined rail block, to have a damping effect on a bouncing coin. The dampening abilities of such an anti bounce block varied, were hard to control and could in some situations even increase bouncing. The best solutions included an anti bounce block made of metal rigidly mounted on the inclined rail block. Surprisingly, a rigidly fastened anti bounce block showed much better anti bounce abilities than if the anti bounce block and inclined rail block where integrated into one piece of metal, intuitively one might think that a frictional screw joint would act as if the parts were integrated but this where not the case. The integrated solution was rejected because of its terrible ability to absorb bouncing. In a further tested solution, the anti bounce block where made of a plastic material but the result was not satisfactory. The theoretical explanation to why chosen design of the anti bounce block showed such satisfactory results is not fully known. According to the theory of the inventors, bouncing energy is absorbed by the anti bounce block mass and transferred away in a beneficial way with this set up.

Figure 11:
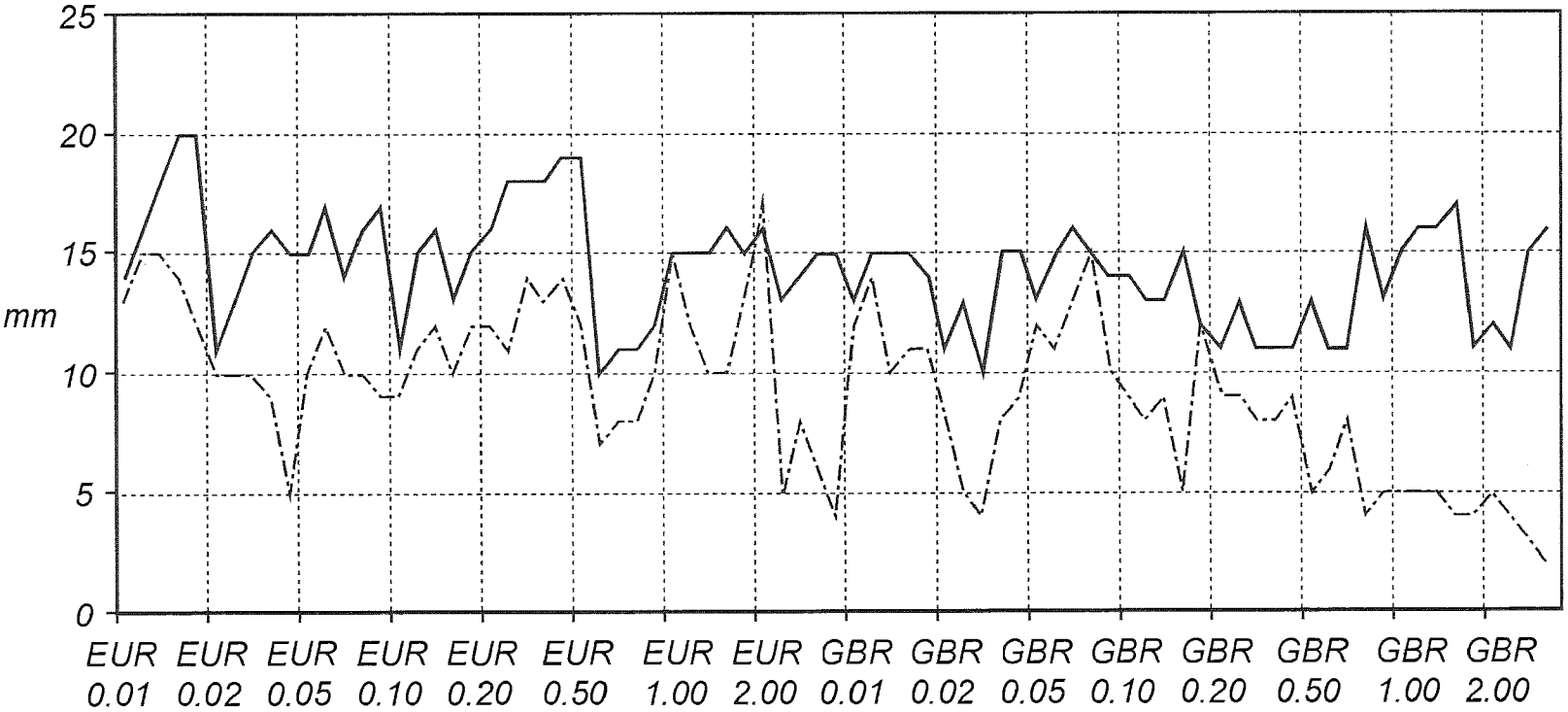
FIG. 11 shows results of a bounce test where coins are released from a point above the anti-bounce block.

Two different designs of the anti bounce block where tested. One design which is explained in detail in conjunction with FIGS. 3 and 4 below and one wedge-shaped design, the wedge-shaped design having its wedge connected at the second end 114 of the separating knife 128. The test was performed by releasing a coin 5-6 times along the length of the anti bounce block. The tests were carried out in the following way: Coins of different denominations were released 50 mm above either a conventional coin rail as is present in WO 2008/024043 or one of the two anti-bounce blocks disclosed in the present application. The results for the conventional coin rail (not shown) indicate that many coins, especially of smaller denominations showed bouncing amplitudes of more than 20 mm and that a small part of these coins showed bouncing amplitudes of up to 25 mm. FIG. 11 discloses results of the test for newly developed anti-bounce blocks. As can be seen in FIG. 11, the anti-bounce block (dotted and dashed line) showed in FIGS. 3-4 results in better anti-bounce abilities than the wedge-shaped block (black line). Occasional outliers may be disregarded since this probably is the result of a coin not being released correctly.

Moreover, the rectangular anti-bounce block has a lower production cost than the wedge-shaped block.

Figure 3:
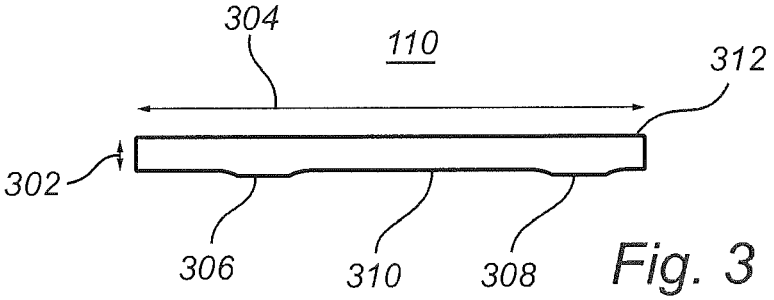
FIGS. 3-4 illustrate a side view and a front view of an anti bounce block, respectively, to be mounted on an inclined rail block according to embodiments of the present disclosure.
Figure 4:
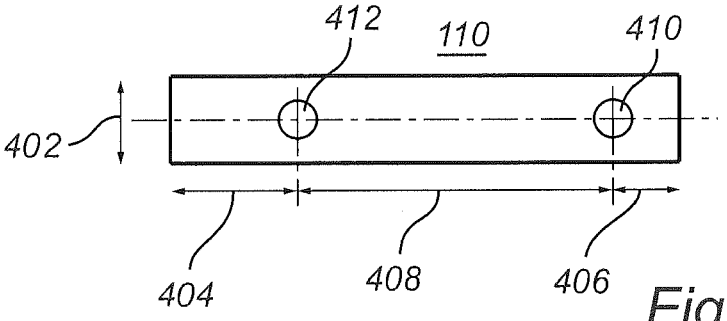

FIGS. 3-4 illustrate by way of example a side view and a front view, respectively, of an anti bounce block 110 to be mounted on an inclined rail block according to embodiments of the present disclosure. The thickness 302 of the anti bounce block 110 is according to some embodiments 5.7 mm. The length 304 is according to some embodiments 73.5 mm. The bulging part 306, 308 in which screw holes 410, 412 (as seen in FIG. 4) is placed are just exemplary. In further embodiments, the bulging parts 306, 308 are left out, thus leading to a completely straight front side 310 of the anti bounce block 110. As can be understood from above, the anti bounce block are rigidly fastened to the inclined rail block of the counting and sorting machine with the back side 312 of anti bounce block 110 towards the inclined rail block. The anti bounce block 110 is according to this embodiment fastened with screws through the screw holes 412, 410 to the inclined rail block. In further embodiments, the anti bounce block 110 is fastened with other fastening means such as glue or a rivet. FIG. 4 shows a front view of the anti bounce block 110. The height 402 is according to some embodiments 12.6 mm. The screw holes 410, 412 are centrally placed height wise and may have a diameter of 5.5 mm. The center of the left screw hole 412 may be placed 18.5 mm from the left side of the anti bounce block 110, as depicted by the arrow 404. The center of the right screw hole 410 may be placed 9.5 mm from the right side of the anti bounce block 110, as depicted by the arrow 406. Consequently, the center of the screw holes 410, 412 may be separated by 45.5 mm, as depicted by the arrow 408. The dimensions of the anti bounce block 110 shown in FIGS. 3-4 are just by way of example, other dimensions are possible.

Figure 5:
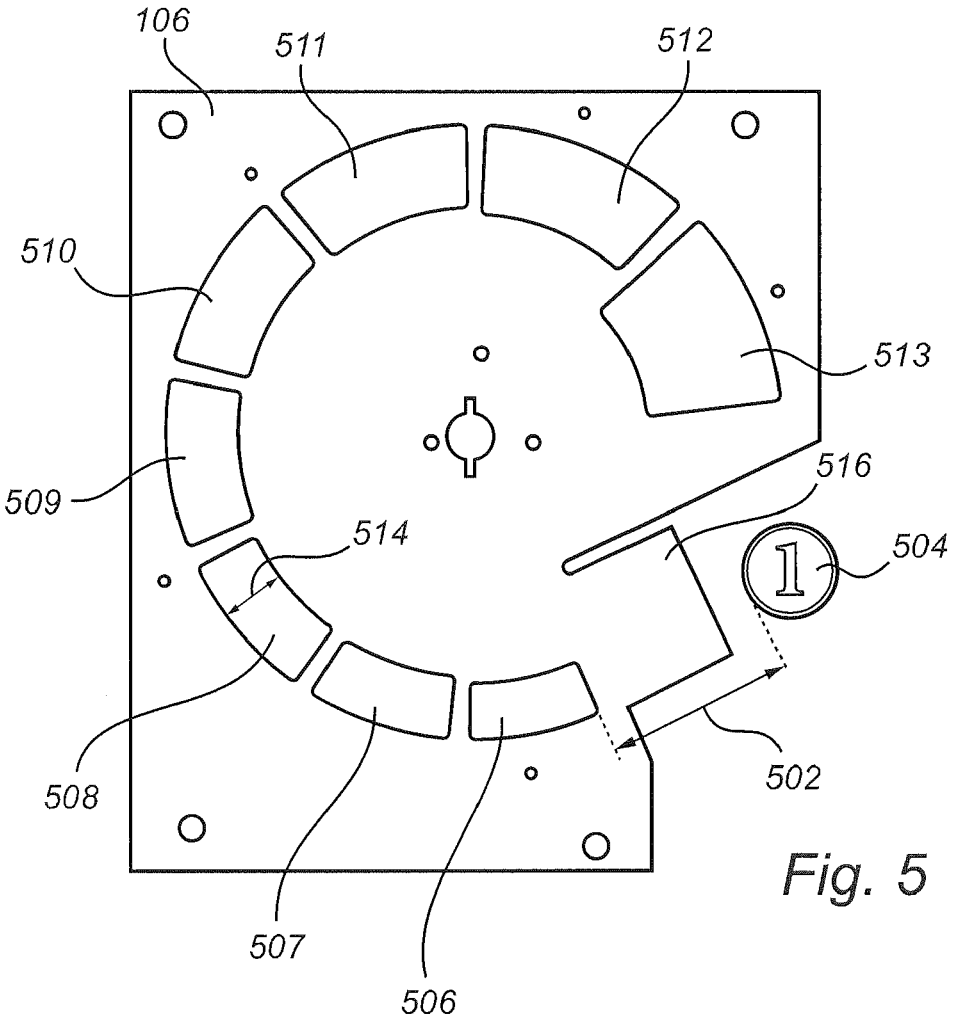
FIG. 5 illustrates the distance between a coin, when engaged by the resilient rim, and a first coin opening of a base plate of the coin sorter according to an embodiment of the present disclosure.
Figure 6:
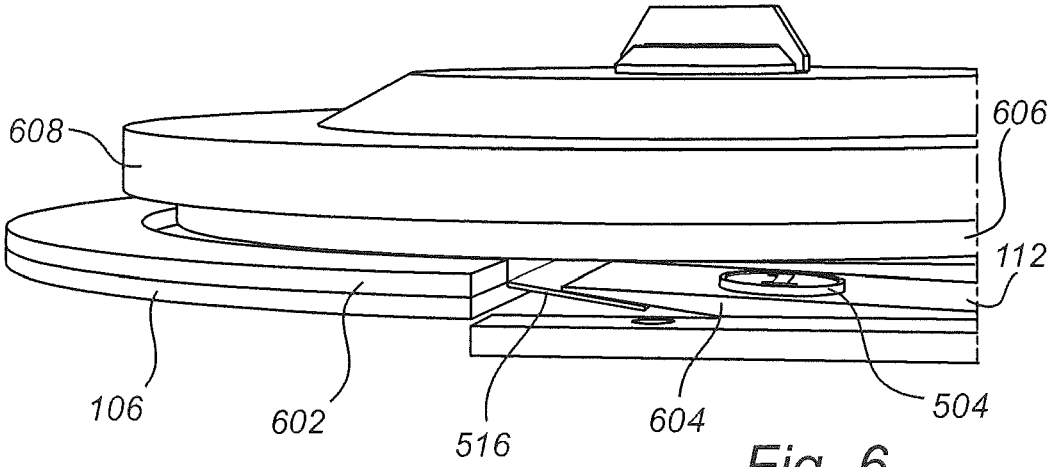
FIG. 6 illustrates a coin being transported on the inclined rail block and soon engaged by the resilient rim of the coin sorter according to embodiments of the present disclosure.

According to embodiments of the present disclosure, there is provided a coin counting and sorting device 100 wherein the design of the inclined rail block 112 is designed to deliver a transported coin 504 to the coin sorter such that a resilient rim 606 of the coin sorter will engage the coin 504 at least 35 mm from a first coin opening 506 of the base plate 106 of the coin sorter. This feature of such a coin counting and sorting device 100 will be explained in conjunction with FIGS. 5-6. FIG. 5 shows by way of example the base plate 106 of a coin sorter, the base plate comprising a plurality of circularly arranged coin openings 506-513. The count of the coin openings and the form of each coin opening are decided by the currency that this particular coin sorter are set up to sort. As can be seen in FIG. 5, the outer edge of each coin opening 506-513 is placed on the edge of an imaginary circle drawn on the base plate 106 with its center at the center of the base plate 106. When sorting a coin 504, the coin is brought in a path across the plurality of circularly arranged coin openings 506-513 such that the part of the coin furthest away from the center of the base plate 106 will be just outside the edge of the imaginary circle during the entire path. As can be understood, the width 514 of the coin opening 506-513, herein exemplified at the coin opening 508, will decide if the coin will fall into the coin opening 506-513 or pass over it. As mentioned above, it may be important that the resilient rim 606 engages the coin 504 at least 35 mm (depicted by the reference 502) before the first coin opening 506. This can be achieved by providing an angled end portion 604 of the inclined rail block 112, as depicted in FIG. 6. By providing the angled end portion 604 according to embodiments, a small coin, such as a 1 cent Euro coin will be engaged approximately 41 mm from the first coin opening 506. A larger coin, such as the 2 Euro coin will be engaged approximately 57 mm from the first coin opening 506. A very large coin, such as the USD 50 cent will be engaged approximately 63 mm from the first coin opening 506. This measures can be compared to prior art where the angled end portion 604 does not exist, and where the coin instead where transported from the plane of the rail block 112 to the plane of the coin sorter via a bent part 516 of the base plate. According to that embodiment of prior art, the exemplary coins above where engaged between 15-27 mm later. A possible consequence of this is that the resilient rim 606 cannot press the coin 504 towards the border 602 of the base plate 106 fast enough, i.e. before the first coin opening 506, thus the risk of miss sorting is increased. A further advantage of the inventive angled end portion 604 of the inclined rail block 112 over the prior art is that in the prior art the coin 504 was brought in below the rim 606 before it was pushed against the rim and engaged by it. According to this new design of the end part 604 of the inclined rail block 112, the coin is now pushed in from the side. Doing so is faster and enables the grabbing procedure to act over a longer distance.

Figure 7:
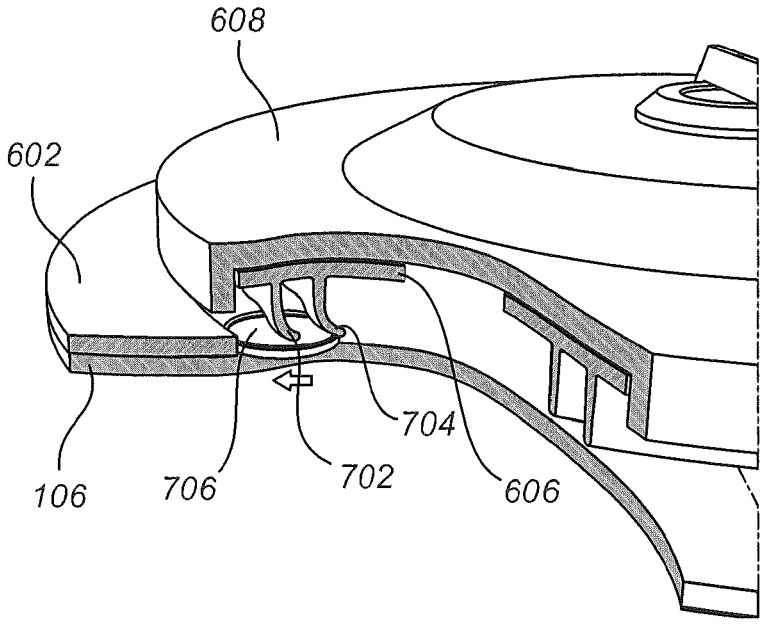
FIG. 7 illustrates a coin being sorted by the coin sorter according to embodiments of the present disclosure.

FIG. 7 shows by way of example a coin being engaged by the resilient rim 606 and thus pressed towards the border 602 of the base plate 106 and brought in a circular path in abutment with the border 602 over the coin openings (not shown). The resilient rim comprises two tapered projecting parts 702, 704. The projecting parts 702, 704 are projecting in a direction perpendicular to the carrier disc 608; for example, perpendicular to the plane defined generally by the carrier disc. When engaging the coin 706, the projecting parts 702, 704 are bent inwards, i.e. away from the border 602, and thus pressing the coin 706 towards the border 602. The amount of bending of course depends on the thickness of the coin 706, the length of the projecting parts 702, 704, and the distance between the lower side of the carrier disc 608 and the upper side of the base plate 106. In one embodiment, the projecting part 702, 704 protrudes 8 mm. According to embodiments, the projecting part 702, 704 protrudes such that the distance between the tip of the projecting part 702, 704 and the base plate 106 is between 0.1 mm and 1.5 mm. If the distance exceeds 1.5 mm, thin coins may not be engaged by the resilient rim 606. According to embodiments, the distance between the tip of the projecting part 702, 704 and the base plate 106 is between 0.1 mm and 1.0 mm.

Since thicker coins thus will make the protruding parts 702, 704 bend more, the area of contact between protruding parts 702, 704 and the coin will increase and consequently the friction between the rim 606 and the coin will also increase. This has the advantage that the risk of the rim 606 losing its engaging power over the heavy thicker coin may be decreased.

As described above, this new inventive design of the resilient rim 606 provides a consistent pressure to the coin to be sorted towards the border 602. An effect of this is that speed of which a coin falling into a coin opening and also the trajectory of the coin falling into the coin opening will be consistent. This significantly reduces the risk of jams in channels leading coins from the coin opening since the risk of a coin "catching up" an equally sorted proceeding coin in the channel is reduced.

Figure 8:
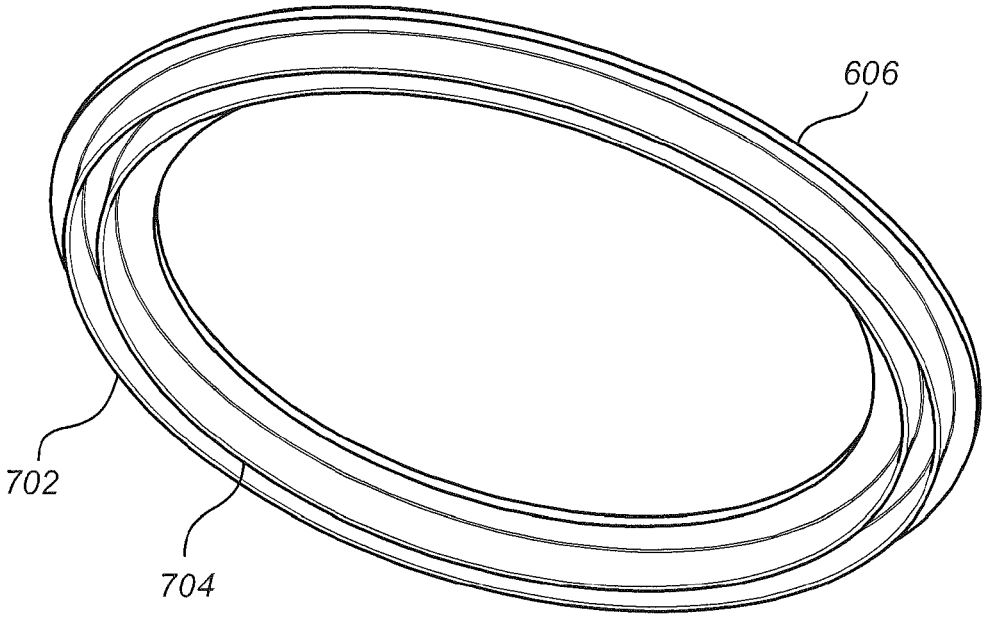
FIG. 8 shows a perspective view of a resilient rim according to embodiments of the present disclosure.
Figure 9:
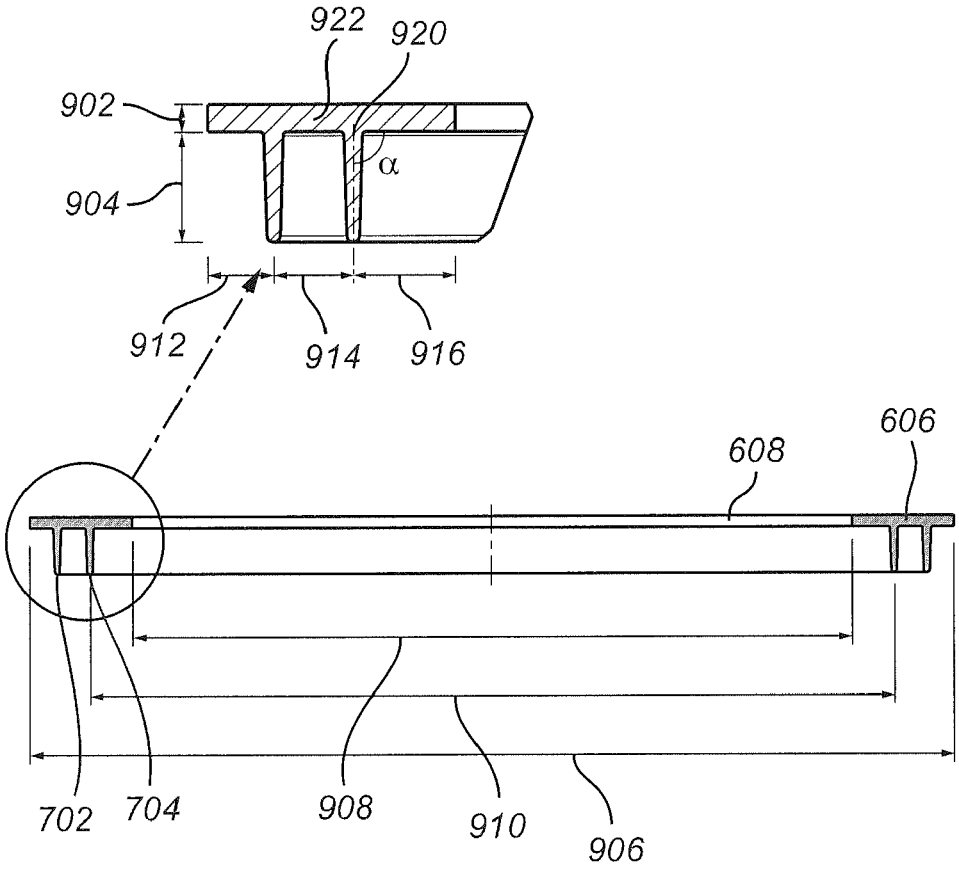
FIG. 9 shows a cross section of the resilient rim of FIG. 8.

FIG. 8 shows by way of example a perspective view of a resilient rim 606 according to embodiments of the present disclosure. FIG. 9 shows a cross section of the resilient rim 606 of FIG. 8 and a cut-out portion showing a cross section of the inventive resilient rim in enlargement. The distance 906 across the carrier disk 608 between the outer parts of the resilient rim 606 is 162 mm. The distance 908 across the carrier disk 608 between the inner parts of the resilient rim 606 is 126 mm. The distance 910 across the carrier disk 608 between the inner projecting parts 704 of the resilient rim 606 is 141 mm. The distance 914 between the outer 702 and the inner 704 projecting part is 5.75 mm. The distance 912 between the outer part of the resilient rim 606 and the outer projecting part 702 is 4.75 mm. The distance 916 between the inner projecting part 704 and the inner part of the resilient rim 606 is 7.5 mm. Each projecting part 702, 704 is 1.38 mm wide at the base 920, and the radius of the top of each projecting part 702, 704 is 0.5 mm. Each projecting part 702, 704 is projecting with an angle α of 90 degrees from the base 922 of the resilient rim. The height 902 of base 922 is 2 mm. Each projecting part 702, 704 protrudes 904 8 mm from the base 922. The above described measurements are only exemplary, for example the diameter of the rotary disk 608 depends on the size or the sorting device. Some of the above mentioned measurements would of course be changed if the rotary disk 608 is med bigger or smaller.

Different possible rim geometries will now be described in conjunction with FIGS. 10*a-c* Figs. that each shows, by way of example, a cross section of an alternative rim geometry according to embodiments of the present disclosure.

Figure 10A:
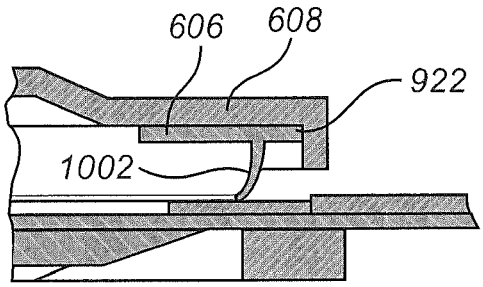
FIGS. 10*a-c* each show an alternative rim geometry according to embodiments of the present disclosure.

FIG. 10*a* shows a resilient rim 606 with one projecting part 1002 protruding from an outer part of the base 922 of the resilient rim 606. This embodiment may significantly reduce miss sorting compared to prior art. Further, the rim 606 shown in FIG. 10*a* may significantly reduce jams in channels leading coins from the coin opening due to a more homogeneous eject behavior of the coins through the coin opening. The rim 606 may be easy to manufacture due to the perpendicular projecting direction of the projecting part 1002. Since only one projecting part 1002 is used, the rim may have to be made of a hard rubber material and may not tolerate the highest sorting speed.

Figure 10B:
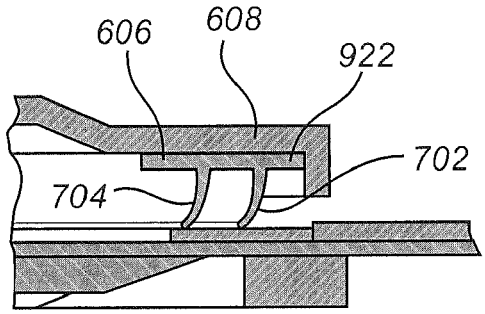

FIG. 10*b* shows a resilient rim 606 with two projecting parts 702, 704 projecting from the base 922 of the resilient rim 606. This is the embodiment shown in FIGS. 9-10. This embodiment may significantly reduce miss sorting compared to prior art. Further, the rim 606 shown in FIG. 10*b* may significantly reduce jams in channels leading coins from the coin opening due to a more homogeneous eject behavior of the coins through the coin opening. The rim 606 may be easy to manufacture due to the perpendicular projecting direction of the protruding parts 702, 704. Since two projecting parts 702, 704 is used, the rim may be made of a softer rubber material and may tolerate a high sorting speed.

Figure 10C:
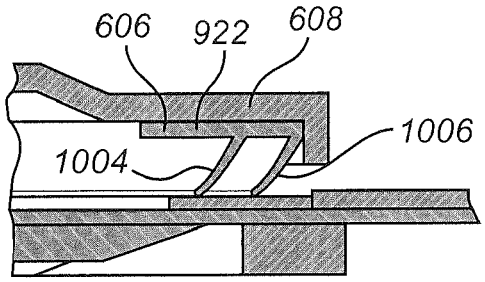

FIG. 10*c* shows a resilient rim 606 with two projecting parts 1004, 1006 projecting from the base 922 of the resilient rim 606. Each projecting part 1004, 1006 is projecting in a direction slightly inwards the center of the carrier disc 608 holding the resilient rim 606. This embodiment may reduce miss sorting compared to prior art. Further, the rim 606 shown in FIG. 10*c* may reduce jams in channels leading coins from the coin opening due to a fairly homogeneous eject behavior of the coins through the coin opening. Since two projecting parts 1004, 1006 is used, the rim may be made of a softer rubber material and may tolerate a high sorting speed.

Bellow follows a table showing miss sorting statistics depending on the design of the resilient rim (shown in FIGS. 10*a-c*) and the material of the rim.

| Prototype | Material | Denomination | Nbr of coins | Miss sorting | % |
|---|---|---|---|---|---|
| B | EL 50 | SD 0.01€ | 67000 | 0 | 0 |
| B | EL 50 | SD 0.50€ | 33000 | 0 | 0 |
| B | EL 50 | Mix€ | 18000 | 4 | 0.022 |
| B | EL 50 | SD 0.20€ | 76000 | 0 | 0 |
| A | EL 50 | SD 0.20€ | 11000 | 8 | 0.07 |
| A | EL 50 | Mix€ | 830 | 4 | 0.5 |
| A | EL 50 | SD 0.20€ | 160000 | 7 | 0.004 |
| B | EL 60 | Mix€ | 112000 | 2 | 0.002 |
| B | EL 60 | SD 0.5€ | 102000 | 2 | 0.002 |
| B | EL 60 | SD 2€ | 101000 | 0 | 0 |
| C | EL 60 | SD 0.20€ | 122000 | 3 | 0.002 |
| C | EL 60 | Mix€ | 200000 | 1 | 0.0005 |
| C | EL 60 | SD 1€ | 200000 | 1 | 0.0005 |
| B | EL 70 | SD 0.20€ | 100000 | 0 | 0 |
| B | EL 70 | SD 0.01€ | 100000 | 0 | 0 |
| B | EL 70 | Mix€ | 100000 | 2 | 0.002 |
| C | EL 70 | Mix€ | 12000 | 5 | 0.04 |
| C | EL 70 | SD 0.20€ | 100000 | 3 | 0.003 |
| A | EL 70 | Mix€ | 250000 | 0 | 0 |
| B | EL 85 | SD 1€ | 110000 | 1 | 0.0009 |
| C | EL 85 | Mix€ | 250000 | 5 | 0.002 |
| C | EL 85 | SD 1€ | 7500 | 3 | 0.04 |
| A | EL 85 | SD 0.05€ | 30000 | 100 | 0.3 |
| A | EL 85 | SD 0.20€ | 108000 | 0 | 0 |

In the above statistics: SD=single denomination, Mix=Mixed denominations. The prototype refers to which embodiment shown in FIGS. 10*a-c* that is used. The material column refers to the hardness of the rubber material (Nitrile rubber). The hardness is defined according to the Shore A hardness scale which measures the hardness of flexible mold rubbers that range in hardness from very soft and flexible, to medium and somewhat flexible, to hard with almost no flexibility at all. According to the table above, for Nitrile rubber the hardness EL 60 is advantageous but other hardness works well for the purpose of sorting coins correctly. For other material types, such as TPE or TPU, the preferred hardness may differ. It may be noted that measurements other than the coin sorting accuracy, such as durability of the material, may be important when deciding the hardness of the material of the resilient rim.

The person skilled in the art realizes that the present disclosure by no means is limited to the preferred embodiments described above. On the contrary, many modifications and variations are possible within the scope of the appended claims. For example, the design of the coin counting and sorting device described above is just exemplary, other ways of feeding coins to the coin sorter is equally possible.

Additionally, variations to the disclosed embodiments can be understood and effected by the skilled person, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A coin sorter comprising:

a base plate comprising an upper and a lower surface, the upper surface having a circular border having an opening, and a plurality of circularly arranged coin openings, each opening being in vicinity of the border; and a carrier disc mounted above the upper surface of the base plate, the carrier disc being concentric with respect to the circular border of the base plate and rotatable around a center axis of the base plate, the carrier disc comprising a resilient rim on the side facing the upper surface of the base plate, the rim being aligned with the plurality of circularly arranged coin openings, wherein the coin sorter is arranged to receive a coin through the opening of the circular border, wherein the resilient rim is arranged to engage the coin and bring the coin in abutment with the circular border in a path across the plurality of circularly arranged coin openings, and wherein the resilient rim comprises at least one circumferentially arranged projecting part, wherein the at least one circumferentially arranged projecting part projects from the carrier disc towards the upper surface of the base plate, defines a coin engaging tip at a free edge of the projecting part, and is adapted such that the tip always bends inwards towards the center of the carrier disc and away from the circular border when a coin to be sorted is engaged by the tip.

2. The coin sorter according to claim 1, wherein the at least one circumferentially arranged projecting part projects from the carrier disc towards the upper surface of the base plate, in a direction perpendicular to the plane of the carrier disc.

3. The coin sorter according to claim 1, wherein the at least one circumferentially arranged projecting part is tapered in the projecting direction.

4. The coin sorter according to claim 1, wherein the at least one circumferentially arranged projecting part is tapered within the range of 1-5 degrees.

5. The coin sorter according to claim 1, wherein the at least one circumferentially arranged projecting part is made from one of Nitrile rubber, TPE and TPU.

6. The coin sorter according to claim 1, wherein the complete resilient rim is made from one of nitrile rubber, TPE and TPU.

7. The coin sorter according to claim 1, wherein the at least one circumferentially arranged projecting part protrudes by a distance from the carrier disc within the range of 7.5-9 mm.

8. The coin sorter according to claim 1, wherein the widest part of the at least one circumferentially arranged projecting part has a thickness within the range of 1-4 mm.

9. The coin sorter according to claim 1, wherein the rim is adapted to rotate together with the carrier.

10. A coin sorter comprising:

a base plate comprising:

an upper and a lower surface, the upper surface having a circular border having an opening, and a plurality of circularly arranged coin openings, each opening being in vicinity of the border; and a carrier disc mounted above the upper surface of the base plate, the carrier disc being concentric with respect to the circular border of the base plate and rotatable around a center axis of the base plate, the carrier disc comprising a resilient rim on the side facing the upper surface of the base plate, the rim being aligned with the plurality of circularly arranged coin openings, wherein the coin sorter is arranged to receive a coin through the opening of the circular border, wherein the resilient rim is arranged to engage the coin and bring the coin in abutment with the circular border in a path across the plurality of circularly arranged coin openings, and wherein the resilient rim comprises at least one circumferentially arranged projecting part projecting from the carrier disc towards the upper surface of the base plate in a direction away from the circular border and comprising a coin engaging tip arranged to engage a coin at the upper surface of the base plate.

11. A coin sorter comprising:

a base plate comprising an upper and a lower surface, the upper surface having a circular border having an opening, and a plurality of circularly arranged coin openings, each opening being in vicinity of the border; and a carrier disc mounted above the upper surface of the base plate, the carrier disc being concentric with respect to the circular border of the base plate and rotatable around a center axis of the base plate, the carrier disc comprising a resilient rim on the side facing the upper surface of the base plate, the rim being aligned with the plurality of circularly arranged coin openings, wherein the coin sorter is arranged to receive a coin through the opening of the circular border, wherein the resilient rim is arranged to engage the coin and bring the coin in abutment with the circular border in a path across the plurality of circularly arranged coin openings, and wherein the resilient rim comprises at least one circumferentially arranged projecting part, each of the projecting parts projecting from the carrier disc towards the upper surface of the base plate, and the two projecting parts being separated such that one projecting part is arranged closer to a center of the carrier disc compared to the other.

12. The coin sorter according to claim 11, wherein the two projecting parts are separated from each other by a distance within the range of 5-8 mm.

13. The coin sorter according to claim 11, wherein the projecting part at the longest distance from the center of the carrier disc is projecting at a distance within the range of 4-7 mm from the outer edge of the resilient rim.

14. The coin sorter according to claim 11, wherein the two projecting parts both are projecting slightly towards the centre of the carrier disc holding the resilient rim.

15. The coin sorter according to claim 11, wherein each projecting part of the two circumferentially arranged projecting parts protrudes by a distance from carrier disc within the range of 7.5-9 mm.

16. The coin sorter according to claim 11, wherein the widest part of each projecting part of the two circumferentially arranged projecting parts has a thickness within the range of 1-4 mm.

17. A coin counting and sorting device comprising:

a coin sorter comprising a base plate including an upper and a lower surface, the upper surface having a circular border having an opening, and a plurality of circularly arranged coin openings, each opening being in vicinity of the border; and a carrier disc mounted above the upper surface of the base plate, the carrier disc being concentric with respect to the circular border of the base plate and rotatable around a center axis of the base plate, and the carrier disc comprising a resilient rim on the side facing the upper surface of the base plate, the rim being aligned with the plurality of circularly arranged coin openings, wherein the coin sorter is arranged to receive a coin through the opening of the circular border, wherein the resilient rim is arranged to engage the coin and bring the coin in abutment with the circular border in a path across the plurality of circularly arranged coin openings, and wherein the resilient rim comprises at least one circumferentially arranged projecting part, wherein the at least one circumferentially arranged projecting part projects from the carrier disc towards the upper surface of the base plate, defines a coin engaging tip at a free edge of the projecting part, and is adapted such that the tip always bends inwards towards the center of the carrier disc and away from the circular border when a coin to be sorted is engaged by the tip;

a coin bowl, adapted for receiving a mass of coins to be sorted;

a coin lifting device for receiving and forwarding the mass of coins to be sorted from the coin bowl; and an inclined rail block positioned between the coin lifting device and the coin sorter and inclined downward from the lifting device to the sorter, the inclined rail block configured to transport coins from the coin lifting device, individually to the coin sorter.

18. The coin counting and sorting device according to claim 17, wherein the coin sorter, coin bowl, coin lifting device and inclined rail block are mounted on a front plate of the coin counting and sorting device, and wherein the inclined rail block is designed to deliver the transported coins towards the border of the base plate of the coin sorter.

19. A coin deposit and dispensing apparatus comprising the coin counting and sorting device according to claim 17.

20. A coin counting and sorting device comprising:

a coin sorter comprising a base plate including an upper and a lower surface, the upper surface having a circular border having an opening, and a plurality of circularly arranged coin openings, each opening being in vicinity of the border; and a carrier disc mounted above the upper surface of the base plate, the carrier disc being concentric with respect to the circular border of the base plate and rotatable around a center axis of the base plate, and the carrier disc comprising a resilient rim on the side facing the upper surface of the base plate, the rim being aligned with the plurality of circularly arranged coin openings, wherein the coin sorter is arranged to receive a coin through the opening of the circular border, wherein the resilient rim is arranged to engage the coin and bring the coin in abutment with the circular border in a path across the plurality of circularly arranged coin openings;

a coin bowl, adapted for receiving a mass of coins to be sorted;

a coin lifting device for receiving and forwarding the mass of coins to be sorted from the coin bowl; and an inclined rail block positioned between the coin lifting device and the coin sorter and inclined downward from the lifting device to the sorter, wherein the inclined rail block is configured to transport coins from the coins from the coin lifting device individually to the coin sorter and has an angled end portion, the angled end portion being arranged to transport the coin from a plane behind the coin sorter to the plane of the coin sorter.

21. A coin sorter comprising:

a base plate comprising an upper and a lower surface, the upper surface having a circular border having an opening, and a plurality of circularly arranged coin openings, each opening being in vicinity of the border; and a carrier disc mounted above the upper surface of the base plate, the carrier disc being concentric with respect to the circular border of the base plate and rotatable around a center axis of the base plate, the carrier disc comprising a resilient rim on the side facing the upper surface of the base plate, the rim being aligned with the plurality of circularly arranged coin openings, wherein the coin sorter is arranged to receive a coin through the opening of the circular border, wherein the resilient rim is arranged to engage the coin and bring the coin in abutment with the circular border in a path across the plurality of circularly arranged coin openings, and wherein the resilient rim comprises a plurality of circumferentially arranged projecting parts, each projecting part of the plurality of circumferentially arranged projecting parts projecting from the carrier disc towards the upper surface of the base plate and being separated in a radial direction from each other projecting part of the plurality of circumferentially arranged projecting parts.

22. The coin sorter according to claim 21, wherein the rim is adapted to rotate together with the carrier.

* * * * *